United States Patent [19]

Mrusko et al.

[11] 4,342,940

[45] Aug. 3, 1982

[54] TRIGGERING DEVICE FOR A FLASH LAMP

[75] Inventors: Joseph P. Mrusko, Victor; Wayne D. Everdyke, Fairport, both of N.Y.

[73] Assignee: Xerox Corporation, Stamford, Conn.

[21] Appl. No.: 118,338

[22] Filed: Feb. 4, 1980

[51] Int. Cl.[3] ..... H01J 61/54

[52] U.S. Cl. ..... 313/198; 313/201

[58] Field of Search ..... 313/201, 198; 362/217, 362/306

[56] References Cited

U.S. PATENT DOCUMENTS

| | | | |
|---|---|---|---|
| 2,054,846 | 9/1936 | Zillger | 313/201 X |
| 2,624,023 | 12/1952 | Noel et al. | 313/201 X |
| 2,700,099 | 1/1955 | Pistey et al. | 313/201 X |
| 2,795,724 | 6/1957 | Beeson | 313/201 X |
| 3,651,365 | 3/1972 | Waymouth | 313/198 |
| 3,733,599 | 5/1973 | Fantozzi | 313/201 X |
| 3,851,201 | 11/1974 | Orrvick et al. | 313/113 |
| 3,868,182 | 2/1975 | Kidd | 355/67 |
| 3,968,392 | 7/1976 | Buchta et al. | 313/198 |
| 3,993,922 | 11/1976 | Cosco et al. | 313/198 |
| 4,004,189 | 1/1977 | Cosco et al. | 315/335 |
| 4,010,397 | 3/1977 | Hon | 313/198 X |
| 4,047,064 | 9/1977 | Cosco et al. | 313/201 |
| 4,156,890 | 5/1979 | Hebert et al. | 362/217 X |

FOREIGN PATENT DOCUMENTS 1361073 7/1974 United Kingdom .

*Primary Examiner*—Palmer C. Demeo

[57] ABSTRACT

A flash lamp is retained in a mounting location by means of a resilient conductive member, said member serving also as the means for applying a triggering pulse to initiate the lamp discharge. In one embodiment, the electrode has a T-shaped configuration with the top of the T serving as the medium for applying the triggering pulse along the length of the lamp.

2 Claims, 3 Drawing Figures

TRIGGERING DEVICE FOR A FLASH LAMP

BACKGROUND OF THE INVENTION AND PRIOR ART STATEMENT

The present invention relates to arc discharge flash lamps and, more particularly, to an improved electrical wiring means for triggering said lamps into a conductive state.

Flash lamps have found use in a variety of applications; photography, electro-photography, optical recording, etc. A lamp comprises two spaced apart electrodes within a sealed glass envelope. The envelope is filled with an inert gas at a subatmospheric pressure. The lamp is connected across a high capacity condenser bank which is charged to a potential just below the ionization level of the gas. Upon application of an additional pulse of voltage (the triggering pulse) the gas is ionized causing the condenser bank to discharge through the tube and resulting in emission of a short, intense light flash.

The triggering pulse may be applied in a variety of ways as disclosed in the prior art. Conventionally, a wire is wrapped around the length of the tube and connected to the electrodes or to a conductive strip positioned on the lamp. U.S. Pat. No. 3,868,182 discloses a trigger wire maintained in a parallel spaced relation to the lamp. The triggering pulse may also be applied internal to the tubes as shown in U.S. Pat. Nos. 3,993,922 and 4,047,064, wherein the trigger wire is embedded within the envelope wall.

The triggering mechanism may be other than a wire configuration; in U.S. Pat. No. 4,156,890 an elongated trigger bar is positioned adjacent the lamp envelope while in U.S. Pat. No. 3,733,599, the lamp is placed adjacent a ground conductive member.

In all of the prior art devices, the lamp must be retained or secured in place by a mounting mechanism. The mechanism may take many forms. Typically, the lamp ends are placed within clamps mounted to a housing frame or to another component, such as a reflector and are coupled to the power source through some form of connector. The triggering device of the present invention is adapted to perform two functions: to provide the required triggering voltage and to secure the lamp in a desired location. The device thus eliminates the need for the aforesaid clamping and connecting mechanisms and provides for a flash lamp assembly which is less costly and easier to assemble and repair.

SUMMARY OF THE INVENTION

According to one embodiment of the invention, a resilient T-shaped bar electrode is adapted to retain a flash lamp in a fixed position. The bar electrode also provides the required triggering voltage to the lamp.

In a second embodiment, the bar electrode has an I configuration with the top of the I connected to a conductive element which extends longitudinally along the tube surface.

DRAWINGS

DESCRIPTION

Figure 2:
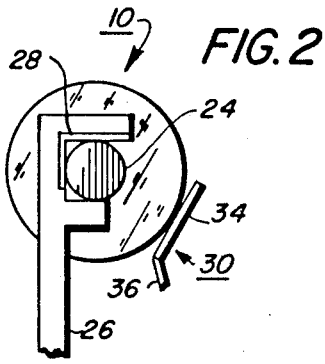
FIg. 2 is an elarged end view of a mounting end block of the FIG. 1 assembly.
Figure 1:
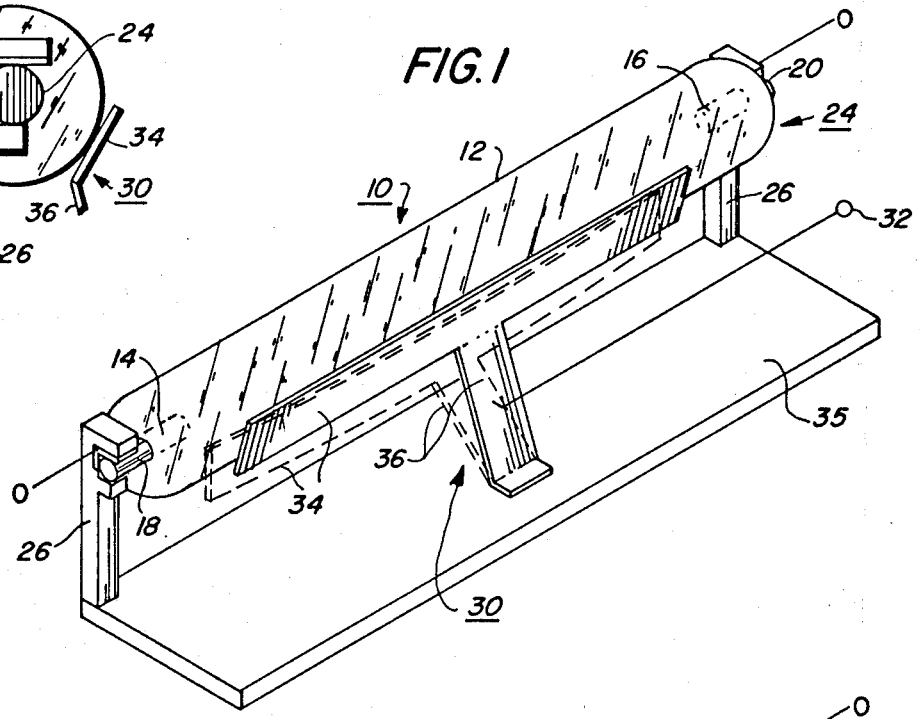
FIG. 1 is a perspective view of a first embodiment of an assembled flash lamp assembly.

Referring to FIGS. 1 and 2, there is shown a preferred embodiment of the invention. Flash lamp 10, which can be a xenon tube, has an elongated envelope 12 having a pair of spaced apart electrodes 14, 16 electrically connected to pins 18, 20. Pins 18 and 20 are seated within recesses 24 of mounting blocks 26 and contact electrical terminals 28. Terminals 28 are connected to a power supply source (not shown) which provides the flashing energy to the lamp.

The pins 18,20 are maintained in intimate contact with terminals 28 by means of a flexibly mounted T-shaped trigger bar electrode 30 connected to a source of triggering voltage 32. Longitudinal segment 34 of the bar electrode is a resilient, conductive member having a length preferably less than the length of envelope 12. Leg 36 of electrode 30 is flexibly mounted at a location to the lamp appropriate for resiliently urging member 34 into contact with envelope 12. This force is transmitted to pins 18 and 20 which are urged into intimate contact with terminals 28. Blocks 26 and electrode 30 are mounted to a suitable insulating surface 35.

Prior to insertion of lamp 10, electrode 30 is in the position shown in dotted form in FIG. 1. Segment 34 has an initial arcuate, or bowed, configuration along its longitudinal dimension. As lamp 10 is inserted downward towards its seated position, initial contact with electrode 30 is made at the opposite ends of segment 34. With continued downward pressure on the lamp, leg 36 assumes an increasingly vertical orientation and the bow in segment 34 gradually flattens out. In its fully seated position, segment 34 is in line tangential contact along the surface of the envelope. Other configurations of member 34 are possible; for example, the member may be dimensioned so that it is substantially flat at all times.

It is thus apparent that bar electrode 30 is serving two purposes; it acts as the means for applying the triggering voltage uniformly across the lamp envelope while also serving to hold the tube in place against the electrical terminals across which the flashing energy is applied.

Figure 3:
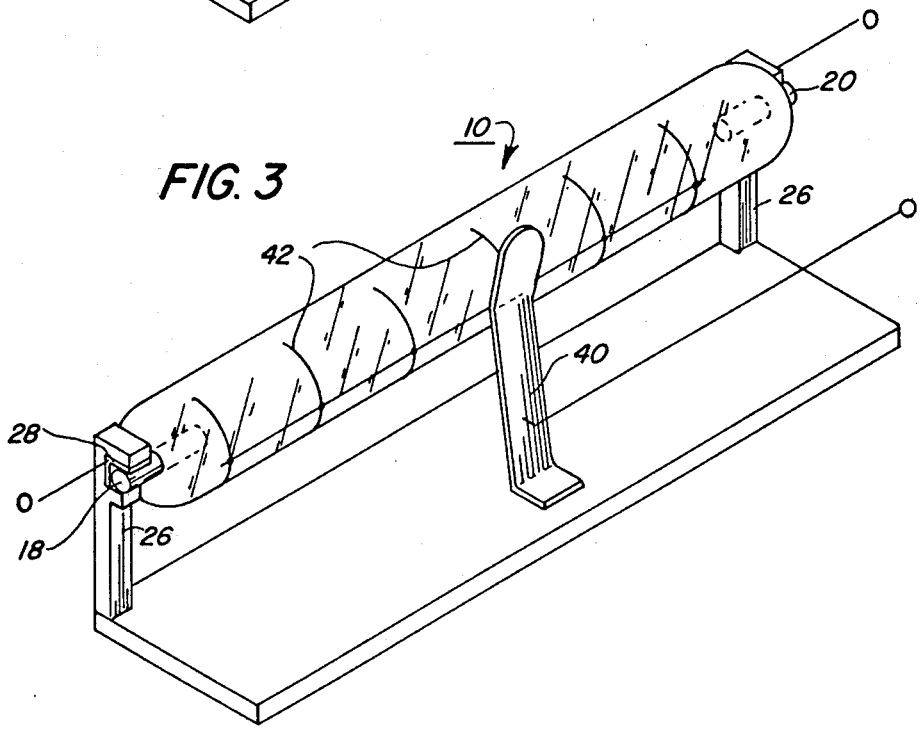
FIG. 3 is a perspective view of a second embodiment of an assembled flash lamp assembly.

A second embodiment of the invention is shown in FIG. 3. In this embodiment, the pin mounting arrangement is the same as shown in FIG. 1 but the lamp is now held in place by a flexibly mounted I-shaped conductive member 40, acting against wire 42 which is wrapped around a portion of envelope 12. Member 40 is flexibly mounted at a location to the lamp appropriate for applying a resilient force to the lamp focused at the point where member 40 is in contact with wire 42. The force is transmitted to the lamp surface and thence to the lamp end pins which are pressed into contact with terminals 28. The triggering and flash operation is as described above, except that, since the bar electrode does not extend a significant distance along the longitudinal dimension of the lamp envelope as in the FIG. 1 embodiment, the uniform distribution of the high ionization voltage is effected by connecting wire 42 as shown. For certain applications, wire 42 may be replaced by a conductive strip formed on the surface of the lamp. Leg 36 would then contact the coating. In these arrangement, the lamp efficiency is increased since a lesser amount of illumination is blocked by the bar electrode.

Preferred materials for the bar electrodes are 17-7PH Stainless Steel with hardness greater than RC55.

Other mounting and/or retaining arrangements are possible consistent with principles of the invention. For example, mounting members 26 may simply have a curved conductive recess on an outer surface which is adapted to seat the end pins. The resilient force would then be applied in a manner sufficient to maintain the pins in contact with the curved recess. In other applications, a recess may not be necessary; the pins may be urged into contact with a conductive patch on an otherwise insulative mounting block. The bar electrodes may also assume other configurations besides the "T" and "I" forms disclosed herein, the main requirement being that the retaining member provide the requisite seating force to the lamp. As a final observation, the bar electrode in the FIGS. 1 and 2 embodiment may, for certain applications, consist of transparent conductive material such as NESA glass.

To summarize the advantages provided by the flash assemblies described above, the initial placement and subsequent repair or replacement of the lamp is greatly simplified, requiring simply a bending back of the electrode to allow insertion or release of the lamp from the mouting member. In a first embodiment, the bar electrode alone transmits and applies the triggering pulse to the lamp, eliminating the need for conductive contact points on the film envelope or additional wire wrapping. Also, no connectors are needed to the lamp electrodes. This reduction of additional components, of course, reduces the cost of the assembly.

What is claimed is:

1. A flash lamp apparatus comprising:

an arc discharge flash lamp having an elongated envelope containing an ionizable gas therein and having;

a pair of electrodes at each end, said lamp being adapted for connection at each electrode to a source of electrical power;

support means for seating said lamp in an operative position;

a resilient T-shaped bar electrode for maintaining said lamp in said seated position, said bar electrode having an elongated upper sequent with opposing major side surfaces, said electrode being mounted so as to engage one of said side surfaces with a substantial portion of the longitudinally extending surface of the lamp envelope; and a source of triggering voltage electrically connected to said bar electrode, the bar electrode applying the triggering voltage to the lamp along the envelope surface contacted by said upper segment side surface so as to cause ionization of said gas;

whereby said bar electrode serves both to fixedly secure the lamp in its operative position while simultaneously applying the required triggering voltage to the lamp.

2. The flash lamp apparatus of claim 1 wherein said upper segment has a longitudinal bowed configuration in its relaxed state, said configuration becoming planar when said lamp is in said mounted position whereby said segment tangentially contacts said envelope along its length, said trigger pulse being applied along said contact surface.

* * * * *

UNITED STATES PATENT AND TRADEMARK OFFICE

CERTIFICATE OF CORRECTION

PATENT NO. : 4,342,940

DATED : August 3, 1982

INVENTOR(S) : Mrusko et al.

It is certified that error appears in the above-identified patent and that said Letters Patent are hereby corrected as shown below:

Col. 1, line 65, "elarged" should read --enlarged--.

Col. 4, line 11, change "sequent" to --segment--.

Signed and Sealed this

*Nineteenth* Day of *October 1982*

[SEAL]

*Attest:*

GERALD J. MOSSINGHOFF

*Attesting Officer*

*Commissioner of Patents and Trademarks*